United States Patent [19]

McIntyre et al.

[11] 4,090,520

[45] May 23, 1978

[54] METHOD OF AND APPARATUS FOR ADHERING SHEET MATERIAL WRAPPINGS AND THE LIKE

[75] Inventors: Donald B. McIntyre; Frederic S. McIntyre, both of Wellesley Hills, Mass.

[73] Assignee: Acumeter Laboratories, Inc., Newton Lower, Mass.

[21] Appl. No.: 750,840

[22] Filed: Dec. 15, 1976

[51] Int. Cl.[2] ..... A24C 1/32; A24C 5/48

[52] U.S. Cl. ..... 131/29; 131/69; 239/70

[58] Field of Search ..... 131/65, 69, 20, 61 R, 131/61 P, 20 A, 71, 34, 35, 37, 76, 15, 29; 118/8; 239/70; 93/1 C, 77 FT

[56] References Cited

U.S. PATENT DOCUMENTS

| | | | |
|---|---|---|---|
| 2,543,277 | 2/1951 | Copeman | 131/69 X |
| 3,512,538 | 5/1970 | Sledge | 131/29 |
| 3,526,231 | 9/1970 | Verbakel | 131/69 X |
| 3,595,204 | 7/1971 | McIntyre et al. | 239/70 X |

*Primary Examiner*—Stephen C. Pellegrino
*Attorney, Agent, or Firm*—Rines and Rines, Shapiro and Shapiro

[57] ABSTRACT

This disclosure is concerned with wrapping sheet material about cylindrical inserts, such as wrapping cigarette paper about filter inserts, with controlled application of spaced adhesive dots or dashes for securing the material to sections of the insert and synchronously controlled cutting of the same to minimize adhesive collection upon the cutter.

10 Claims, 1 Drawing Figure

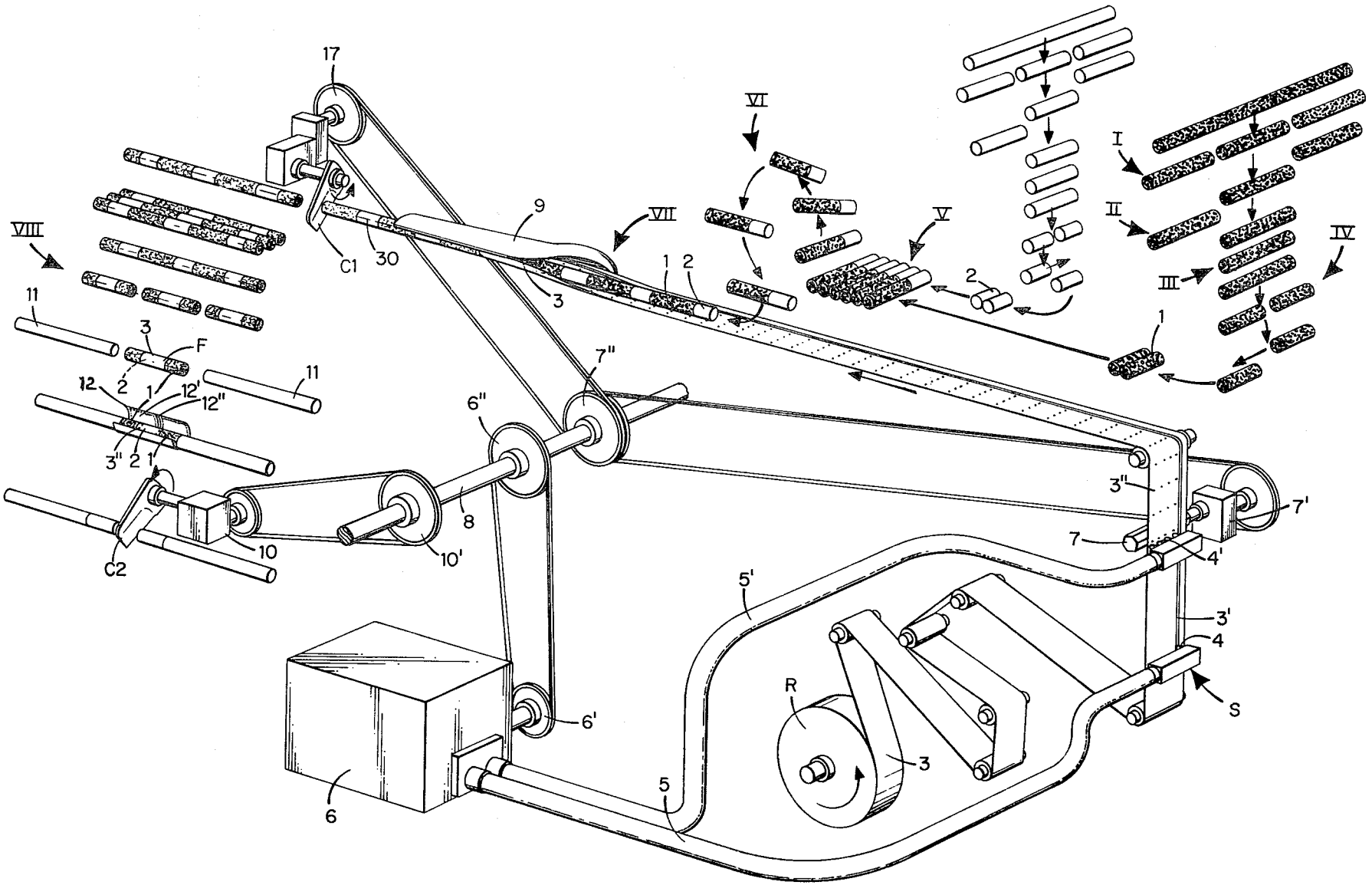
I
II
III
IV
V
VI
VII
VIII
1
2
3
3'
3"
4
4'
5
5'
6
6'
6"
7
7'
7"
8
9
10
10'
11
12
12'
12"
17
30
C1
C2
F
R
S

METHOD OF AND APPARATUS FOR ADHERING SHEET MATERIAL WRAPPINGS AND THE LIKE

The present invention relates to methods of and apparatus for adhering sheet material wrappings and the like, being more particularly directed to the adhesively secured wrapping of such material about cylindrical inserts, such as wrapping cigarette paper or paper substitutes (hereinafter sometimes termed "paper") about filter inserts.

Machines have heretofore been designed and employed for securing cylindrical or rod cigarette filter inserts, including dual or compounded sections of charcoal and cellulose fibers in plastic tubes and the like, within the cigarette, such as those of Hauni-Werke Korber & Co. of Hamburg, Germany, as described, for example, in its May 1976 Dual-Filter Machine Mulfi Bulletin. In accordance with such apparatus, dual filters, as of charcoal and plastic sections of cellulose fibers and the like, have been wrapped with filter wrapping paper to form a rod of successive charcoal and plastic sections, with the wrap adhered by a longitudinal seam of adhesive and with further adhesive regions attaching to the filter sections. The wrapped filter rod is transversely sliced to form the dual filters which are connected to the tobbacco element sticks or rods of the cigarette, as by tipping material sheets. Problems arising with such and similar apparatus include the building up of adhesive material from the wrapping sheet upon the slicers or cutters, and the often inadequate adhesion of the wrapping sheet to the filter sections, particularly when the end of the filter is chewed or unduly moistened.

An object of the present invention is to provide a new and improved method of and apparatus for adherently wrapping and cutting such multiple or other filter inserts that obviate the said problems, greatly reducing the deposition of adhesive on wrapped-filter cutters, and improving the holding action of the wrap upon the filter sections.

A further object is to provide such a novel wrapping and cutting technique that is also adapted for other types of inserts and wraps of more general application, as well, wherein the advantages or some of the advantages of the invention are sought.

Other and further objects will be explained hereinafter and are more particularly delineated in the appended claims. From one of its aspects, the invention, in summary, contemplates a method of wrapping substantially cylindrical inserts within sheet material, that comprises, forming the inserts and feeding the same along a line; feeding a web of the sheet material in the direction of said line to receive the inserts longitudinally thereupon; depositing upon the web prior to its receiving the inserts a longitudinal adhesive line near an edge of the web and succesive sets of longitudinally spaced transversely extending adhesive dots or dashes; controlling the longitudinal spacing between said sets of transversely extending adhesive dots or dashes to correspond to predetermined spaced regions along said inserts; transversely wrapping the adhesive-provided web about the inserts with sufficient overlap to enable securing along said longitudinal adhesive line and to adhere the successive sets of adhesive dots or dashes circumferentially to the inserts at said predetermined regions thereof; and transversely cutting said wrapped inserts synchronously with the presentation of spaces between said sets of adhesive dots or dashes to avoid cutting contact with the same. Preferred details and applications are later set forth.

The invention will now be described with reference to the accompanying drawing, the single FIGURE of which is a schematic isometric view of a preferred apparatus, illustrating the technique as applied to the cigarette filter application.

Referring to the drawing, pre-produced filter rods 1 and 2 (as of charcoal and plastic tubes of cellulose or the like), are schematically shown segmented (I), staggered (II), aligned (III), cut (IV) into desired filter lengths (say from 60 to 150 mm), and grouped (V) in abutting relationship 1–2. The groups 1–2 are turned (VI) and fed in-line (VII) longitudinally upon a wrapping paper or similar sheet web 3, all as described, for example, in said Hauni-Werke bulletin and elsewhere. It is to the improvement of the wrap of the web 3 in this conventional assembly that this invention is primarily directed.

The sheet material web 3 is shown drawn from a supply roll R to an adhesive-application section S (shown vertical), where successive hot melt or similar adhesive applicators 4 and 4' distribute controlled adhesive markings, as follows. The nozzle 4 receives hot melt adhesive via tube 5 from a metering pump 6 which also applies the adhesive by way of tube 5' to the upper transverse nozzle array 4', these structures being, for example, of the types described in our previous U.S. Letters Patent Nos. 3,595,204; 3,294,060; 3,323,510; and 3,174,689. The nozzle 4 produces a continuous longitudinal line or strip 3' of the adhesive near an edge of the web 3, whereas the transverse array of nozzles 4' is fed with metered pulses of hot-melt to generate a corresponding transverse array of adhesive dots 3'', periodically applied, as described in said patents, and more particularly in U.S. Pat. No. 3,595,204. Preferably, the dots are deposited in sharply defined spots with the aid of a multiple-blade bumper element 7, periodically deflecting the web from the left side to contact and wipe the globule of adhesive metered at each nozzle 4' upon the web, as described in our copending U.S. patent application, Ser. No. 537,064, filed Dec. 30, 1974, for Process and Apparatus For Fluid Application. As the sheet web material of wrap paper or the like 3 is thus drawn past nozzle station 4', the successive transverse lines of dots 3'' are longitudinally spaced in a controlled manner, which is adjusted to correspond to the regions or locations of the filter sections 1 and 2 where the wrapping of the web material about the filter is to effect securing therebetween, as later described. The synchronization is shown effected by drive box 7', associated with bumper 7, being driven from shaft 8 via 7'', and with the metering control drive 6' similarly coupled to shaft 8 by sprocket 6''.

The line of filter inserts 1–2 at VII is carried by the web 3, with its adhesive line 3' and spaced transverse dots 3'', to a forming die 9 that wraps the web sheet material 3 transversely and with an overlap to provide a closing and adhesive seal along adhesive line 3', with the spaced transverse lines of dots 3'' circumferentially securing to predetermined regions of the filter. In accordance with the invention, a transverse cutter blade $c_1$, is controlled synchronously with this process, as by pulley drives 17-7'', to insure transverse cuttting of the filter insert at a region between transverse dots 3'', limiting the contact of the blade $c_1$ with adhesive material to the cut of the line 3', and avoiding adhesive build-up on the cutting edge. The resulting multiple dual filter rods are further cut, as at VIII, and again preferably by a similarly synchronized cutter (not shown), slicing the filter in the space between dots 3″. At this point, a wrapped pair of contiguous dual filters F, is provided with the plastic section 2 shown in the center and the charcoal filter 1 sections at the ends. This is abutted against tobbaco sticks 11, and secured with a tipping or other wrap 12, having an inner surface of adhesive 12′, but with a central line 12″ void of adhesive, all as effected, for example, in said Hauni-Werke machine and bulletin. In accordance with the present invention, this conventional step is followed by a further synchronized transverse cutting by cutter $C_2$, synchronized by drive 10—10′ from shaft 8, again insuring cutting in the space between dots 3″ and along the void line 12″ to restrict the adhesive contacting the blade to the single line 3′, as before.

Symmetrical cigarettes with dual filters are thus provided with a very adherent completely or partly circumferential bond at dots 3″ to the desired regions of filter insert section 1 and 2 only, and with minimal adhesive contamination of the cutters. If desired, moreover, the dots 3″ may be extended into dashes or a single dash. Suitable hot melt adhesives for the line 3′ include, for example, a polyethelene-base with copolymer additives sold by H. B. Fuller of St. Paul, Minnesota, under the type 5134B, or that of Swift Company of Chicago, Illinois, type 625. The hot melt adhesive of the dots or dashes 3″ may be tailored to the particular plastic 2 or other characteristics of the filter sections. Suitable pressure-sensitive materials for this purpose include H.B. Fuller type HM 1097 cryton base or synthetic rubber base with copolymer additives; type 1477 of Boler Petroleum Co., Ardmore, Pennsylvania; and type 321 of Union Oil Co., California. The dots 3″ may, for example, be from 1/64–1/16 inch in diameter, more or less, spaced longitudinally every 5 mm or so.

Instead of the bumper control illustrated, moreover, other fine control deposition systems may be employed, such as the rotary distributor application described in said U.S. Pat. No. 3,174,689 and the other patents. The technique, moreover, may be applied to other applications than that of cigarette filters where cylindrical or other inserts must be wrapped and the features of the invention are desired; and further modifications will also occur to others skilled in this art—such being considered to fall within the spirit and scope of the invention as defined in the appended claims.

What is claimed is:

1. A method of wrapping substantially cylindrical inserts within sheet material, that comprises, forming the inserts and feeding the same along a line; feeding a web of the sheet material in the direction of said line to receive the inserts longitudinally thereupon; depositing upon the web prior to its receiving the inserts a longitudinal adhesive line near an edge of the web and successive sets of longitudinally spaced transversely extending adhesive dots or dashes; controlling the longitudinal spacing between said sets of transversely extending adhesive dots or dashes to corrrespond to predetermined spaced regions along said inserts; transversely wrapping the adhesive-provided web about the inserts with sufficient overlap to enable securing along said longitudinal adhesive line and to adhere the successive sets of adhesive dots or dashes circumferentially to the inserts at said predetermined regions thereof; and transversely cutting said wrapped inserts synchronously with the presentation of spaces between said sets of adhesive dots or dashes to avoid cutting contact with the same.

2. A method as claimed in claim 1 and in which said inserts comprise cigarette filters and said cutting produces a pair of contiguous wrapped filters, with the wrapping sealed by said longitudinal adhesive line and transversely secured at said regions of the filter by said sets of adhesive dots or dashes.

3. A method as claimed in claim 2 and in which tobbacco elements are abutted on each side of said pair of contiguous wrapped filters; tipping sheet material is adhesively wrapped over the filters but with a transverse line thereof void of adhesive and disposed in a space between successive sets of said adhesive dots or dashes; and further cutting said tipping-wrapped contiguous filters with their respective abutting tobbacco elements along said transverse line to form a pair of filter cigarettes, while avoiding cutting contact with other than the said longitudinal adhesive line.

4. A method as claimed in claim 3 and in which said contiguous filters comprise a center section with further sections on each side thereof, and a plurality of said sets of adhesive dots or dashes are provided on said center section such that upon cutting the same, the said web sheet material remains secured thereto on both sides of the cut.

5. A method as claimed in claim 4 and in which said center section comprises a fiber-filled plastic tube and said further sections comprise charcoal filter sections.

6. A method as claimed in claim 5 and in which the adhesive of said longitudinal line comprises a hot melt polyethelene base with copolymer additives, and said adhesive of said sets of dots or dashes comprises pressure-sensitive hot melt adhesive.

7. A method as claimed in claim 2 and in which said depositing and controlling steps comprise periodically bumping the web on one side thereof to deflect it against synchronously produced adhesive globules on the other side to produce said sets of spaced dots or dashes.

8. Wrapping apparatus and the like having, in combination with means for feeding inserts longitudinally upon a web of wrapping sheet material, means for applying a longitudinal adhesive line near an edge of the web; means for periodically applying successive sets of transversely extending adhesive dots or dashes at longitudinally spaced intervals along said web; means for controlling the longitudinal spacing between such sets to correspond to predetermined spaced regions along said inserts; means for transversely wrapping the adhesive-provided web about the inserts with sufficient overlap to enable securing along said longitudinal adhesive line and to adhere the successive sets of adhesive dots or dashes circumferentially to the inserts at said predetermined regions thereof; and means for transversely cutting said wrapped inserts synchronously with the presentation to the cutting means of spaces between said sets of adhesive dots o dashes to avoid cutting contact with the same.

9. Wrapping apparatus as claimed in claim 8 and in which said inserts are cigarette filters and said web material is filter wrapping material.

10. Wrapping apparatus as claimed in claim 9 and in which said applying and controlling means comprise bumper means disposed on one side of the web to deflect the same against nozzle means disposed on the other side, and there is further provided means for supplying the nozzle means with adhesive globules synchronously with the operation of the bumper means to produce said sets of spaced adhesive dots or dashes.

* * * * *